US005642761A

United States Patent [19]

Holbrook

[11] Patent Number: 5,642,761

[45] Date of Patent: Jul. 1, 1997

[54] LIQUID PROPORTIONING APPARATUS AND METHOD

[75] Inventor: Ben F. Holbrook, Kaysville, Utah

[73] Assignee: Fountain Fresh, Inc., Salt Lake City, Utah

[21] Appl. No.: 604,707

[22] Filed: Feb. 21, 1996

[51] Int. Cl.[6] ..... B65B 03/00

[52] U.S. Cl. ..... 141/104; 141/5; 141/6; 141/9; 141/40; 141/47; 141/50; 141/95

[58] Field of Search ..... 141/5, 6, 9, 39–41, 141/47–50, 95, 100, 104, 105; 72/299

[56] References Cited

U.S. PATENT DOCUMENTS

| | | | |
|---|---|---|---|
| 2,733,850 | 2/1956 | Welty et al. | 141/6 |
| 3,653,414 | 4/1972 | Weidner | 141/104 X |
| 3,661,191 | 5/1972 | Harley et al. | 141/41 |
| 4,611,641 | 9/1986 | Carter, Sr. | 141/9 X |
| 4,805,672 | 2/1989 | Barrettini et al. | 141/5 |
| 5,207,251 | 5/1993 | Cooks | 141/104 X |
| 5,240,048 | 8/1993 | Diehl | 141/39 |
| 5,339,874 | 8/1994 | Cragun | 141/9 |

*Primary Examiner*—J. Casimer Jacyna
*Attorney, Agent, or Firm*—J. Winslow Young

[57] ABSTRACT

A liquid proportioning apparatus for proportioning two or more liquids into a bottle. The liquids are accurately proportioned in the bottle by sensing the respective pressure increases in the bottle as each liquid is introduced into the bottle. The bottle is initially pressurized to a first pressure setting to establish a base-line so that subsequent pressure change caused by an incoming liquid will be proportional to the volume of that liquid to the total volume of the bottle. This invention is primarily directed to the selective production of a beverage from a syrup and water or carbonated water.

15 Claims, 2 Drawing Sheets

LIQUID PROPORTIONING APPARATUS AND METHOD

BACKGROUND

1. Field of the Invention

This invention relates to proportioning systems for proportioning liquids, and, more particularly, to a novel apparatus and method for providing a beverage that is prepared from accurate proportions of at least two different liquids such as a flavored syrup and carbonated water.

2. The Prior Art

Various liquid products are produced from two or more liquids which are blended in preselected proportions to produce the final product. For example, a beverage is produced from a syrup which is blended with either plain or carbonated water and dispensed into a suitable container such as a bottle. One exciting new development in the beverage market is the recent trend toward a customer-operated beverage dispenser that dispenses any one of a number of preselected beverages directly into the customer's bottle. In the case of carbonated beverages, a syrup is premixed with carbonated water before it is introduced into the particular bottle. One such system is disclosed in U.S. Pat. No. 5,339,874. Perhaps the greatest difficulty encountered by such a system as that described in the foregoing patent is the fact that it requires the use of a very expensive proportioning pump in order to achieve the correct ratio between the syrup and the carbonated water. One such proportioning pump is described in U.S. Pat. No. 5,388,725. As can be readily seen, a beverage kiosk capable of delivering, say, ten different beverage flavors will require ten different proportioning pumps in order to provide a separate proportioning pump for each of the beverage flavors dispensed thereby. This alone increases the cost for each beverage kiosk by hundreds, if not thousands, of dollars.

Historically, proportioning pumps were required in this type of beverage dispensing kiosk since the fill mechanism operated on a simple fill concept wherein the preblended beverage produced by the proportioning pump was simply dispensed into the bottle until the bottle was filled regardless of the size of the bottle. This allowed the customer to select from a range of sizes of suitable bottles for the preselected beverage. Importantly, the correct proportions of the various liquids was obtained, as stated above, through the use of relatively expensive proportioning pumps.

One alternative to these types of proportioning pumps would be for the customer to designate the size of bottle to be filled at the time the beverage flavor selection as made. The proper quantity of syrup would then be dispensed directly into the bottle and then the bottle would be filled with carbonated water. However, such a system is fraught with the potential for fraud on the part of the customer in that it is conceivable that the customer could designate a large capacity bottle while actually using a smaller capacity bottle in order to obtain a beverage having a high concentration of syrup. Since the beverage is sold by bottle size the kiosk owner would be cheated out of the value of the extra syrup obtained by the foregoing scheme.

Another problem with this type of proportioning pump is the fact that if one wants to change the ratios of the two liquids blended by the proportioning pump one must physically alter the respective settings of the pistons, etc., in the proportioning pump. This becomes particularly relevant if one desires to selectively alter the syrup ratio of a beverage to satisfy certain regional tastes for that particular beverage.

Another major drawback to the conventional proportioning pump is that it is not configured to being capable of dispensing a beverage prepared from more than two liquid constituents. This means that in the absence of extensive redesign, the conventional proportioning pump can not be used to produce, say, a low carbonation beverage wherein water is added to the beverage in conjunction with carbonated water in order to produce the low carbonation condition called for in that particular beverage.

In view of the foregoing, it would be an advancement in the art to provide a relatively simple apparatus and method for dispensing accurate proportions of two or more liquid components of a liquid solution into a container. It would be an even further advancement in the art to provide a beverage dispensing apparatus that is particularly characterized by the absence of proportioning pumps. It would also be an advancement in the art to provide a beverage dispensing apparatus and method for selectively changing the proportions of the various liquid components of a beverage in order to meet differences in consumer preferences in different areas of the world. It would also be an advancement in the art to provide a beverage dispenser apparatus and method that dispenses accurately proportioned liquid constituents into a bottle regardless of the size of the bottle. Another advancement in the art would be to dispense accurate proportions of two or more liquid components into a container. Such a novel apparatus and method is disclosed and claimed herein.

BRIEF SUMMARY AND OBJECTS OF THE INVENTION

The present invention is a novel liquid proportioning apparatus and method for dispensing an accurate quantity of at least the syrup portion of the liquid into the bottle as a function of the capacity of the bottle. The proportionate filling of the bottle is commenced by sealingly engaging the bottle to the fill head after which the bottle is pressurized with a gas such as carbon dioxide to a preselected, first pressure setting. The syrup is introduced into the bottle where it compresses the gas therein to cause an increase in pressure until a second pressure setting is reached. The pressure ratio of the second pressure setting and the first pressure setting represents the ratio of the volume of syrup in the bottle to the total capacity of the bottle thereby providing an accurate quantity of syrup in the bottle. The pressure is then released and a second liquid such as carbonated water is introduced into the bottle until it is filled. When carbonated water is the last liquid to enter the bottle the pressure from the bottle is released through a restriction valve to maintain a certain level of back pressure on the bottle in order to reduce excessive carbon dioxide loss through effervescence. In the event more than two liquids are to be dispensed into the bottle the system can be adjusted so that each succeeding liquid raises the pressure in the bottle to a next preselected pressure setting at which time the flow is stopped before the next liquid is introduced.

It is, therefore, a primary object of this invention to provide improvements in apparatus for filling a container with accurately proportioned quantities of at least two different liquids.

It is another object of this invention to provide improvements in the method of accurately proportioning multiple liquids in a container.

Another object of this invention is to provide a liquid proportioning apparatus particularly characterized by the absence of a proportioning pump.

Another object of this invention is to provide a liquid proportioning apparatus wherein the relative proportions of the various liquid components can be selectively changed to meet predetermined ratio requirements for the final liquid.

Another object of this invention is to provide an apparatus that produces on demand a beverage from a syrup and carbonated water wherein the syrup and carbonated water are separately dispensed into a bottle.

Another object of this invention is to provide an apparatus that produces on demand a low carbonation beverage from a syrup, water, and carbonated water.

Another object of this invention is to provide a beverage dispensing apparatus wherein multiple liquids are dispensed serially into a bottle as accurate proportions regardless of the size of the container.

These and other objects and features of the present invention are more fully understood from the following description with its accompanying drawing and the appended claims.

DETAILED DESCRIPTION OF THE PREFERRED EMBODIMENT

Figure 1:
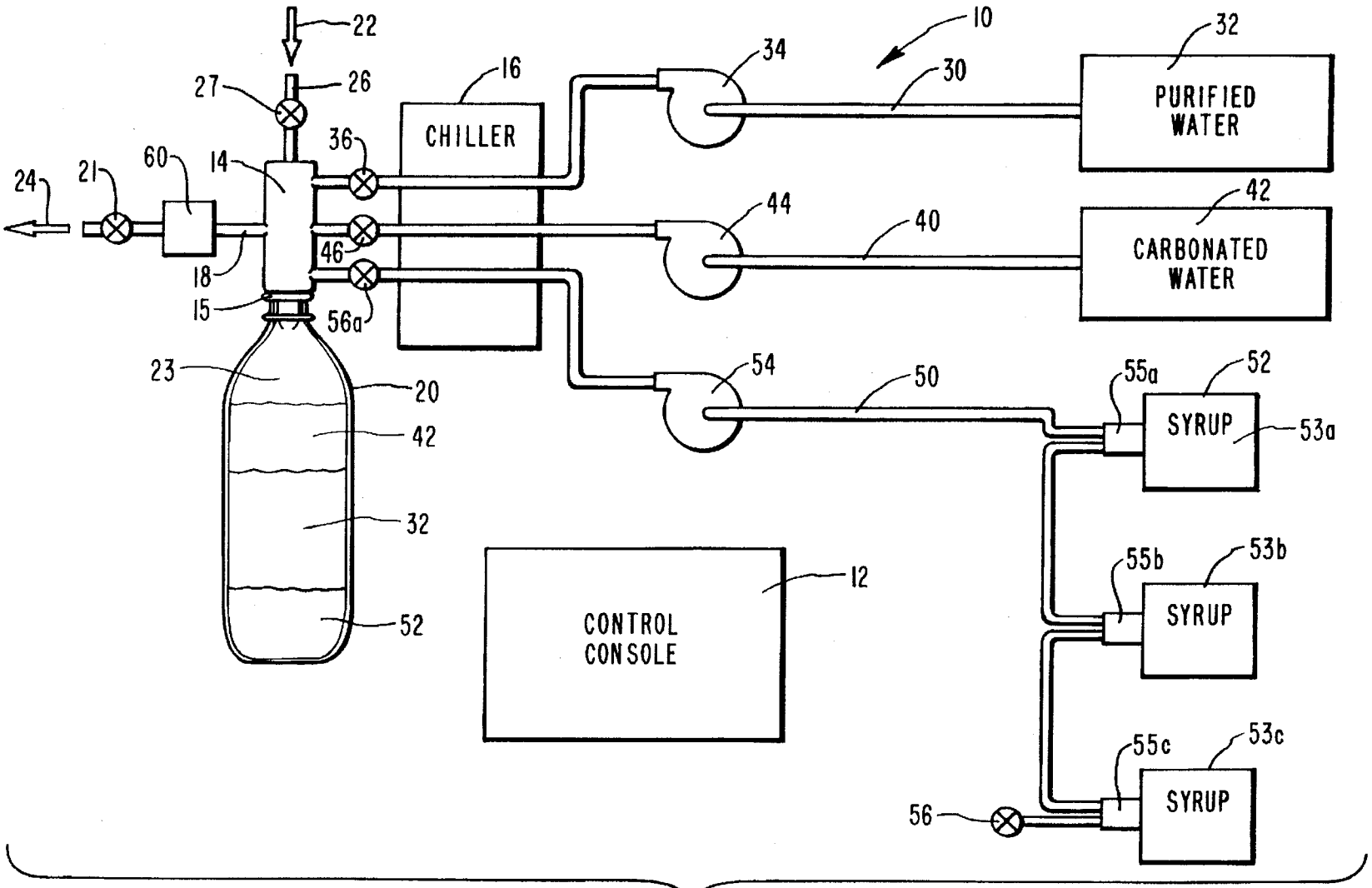
FIG. 1 is a schematic diagram of the liquid handling system for one syrup of the novel liquid proportioning apparatus of my invention.

The invention is best understood from the following description and with reference to the drawing wherein like parts are designated by like numerals throughout and taken in conjunction with the appended claims.

General Discussion

The novel liquid proportioning apparatus and method of my invention is specifically designed to dispense beverages in the preselected ratios of syrup and either water or carbonated water. Importantly the ratio of syrup to the water portion is accurately measured regardless of bottle size so that the correct beverage proportions are delivered to the customer. The beverage is dispensed in the absence of either customer identification or pre-entry of bottle size, or, more advantageously, in the absence of proportioning pumps. My novel discovery utilizes a unique approach in that it operates on the basis of the change in bottle pressure as the syrup is introduced into the bottle. The bottle is initially pressurized with a gas to a first pressure setting so that when the syrup is introduced into the bottle it increases the pressure in the bottle. Upon reaching a second, preselected pressure setting the flow of syrup is stopped. The detected pressure change between the first pressure setting and the second pressure setting represents the ratio of syrup to remaining bottle volume. This ratio remains constant regardless of bottle size. The balance of the bottle is then filled with either water or carbonated water or a combination of the two to complete the preparation of the selected beverage. Another important aspect of my invention is the fact that accurate proportions of more than two liquids can be introduced into the bottle. This is accomplished by simply establishing a third pressure setting to which the second liquid will raise the pressure inside the bottle before the flow of the second liquid is stopped.

Preferably, due to the effervescent nature of carbonated water, the carbonated water is added last. A partial back pressure is maintained on the bottle during the final filling phase with carbonated water in order to reduce effervescence of the carbon dioxide from the carbonated water. This back pressure is maintained by restricting the escape of displaced gas through a capillary tube, construction valve, or the like.

Another important feature of my invention is that the ratio between syrup and water can be selectively predetermined to adapt the novel system of my invention for different parts of the world where cultural differences result in beverages having different syrup concentrations. Further, my unique invention can easily be adapted for any liquid/liquid proportioning system, even those systems involving more than two liquids.

Detailed Description

Referring now to FIG. 1, the novel liquid proportioning apparatus of this invention is shown generally at 10 and includes a control console 12 (the details of which will be discussed more fully with respect to FIG. 2), a purified water system 30, a carbonated water system 40, a syrup system 50, a fill head 14, a chiller 16, and a bottle 20. A pressure sensor 60 is coupled to fill head 14 through an outlet conduit 18 so as to be in fluid communication with the interior of bottle 20. A vent valve 21 is included in outlet conduit 18. Control console 12 is designed to electronically regulate all of the features of liquid proportioning apparatus 10 so as to produce the desired beverage in bottle 20. Fill head 14 is described more fully in U.S. Pat. No. 5,339,874 where also will be found a more detailed discussion of the bottle retract and sterilization systems that are utilized in filling bottle 20 according to the teachings of this invention.

Fill head 14 is designed to sealingly engage bottle 20 at a seal 15 in order to accommodate the necessary pressure sensing capability of pressure sensor 60. A gas 22 is introduced into bottle 20 through an inlet line 26 and inlet valve 27 from a source (not shown) of pressurized gas, preferably carbon dioxide. Carbon dioxide is preferred since its sterility is assured, and it is also readily available since it is used to produce the carbonated water 42 for carbonated water system 40. Carbon dioxide has another advantage in that it purges oxygen from bottle 20 since the presence of oxygen could, over time, affect the flavor of the beverage in bottle 20. Residual carbon dioxide in bottle 20 is shown as gas 23.

Chiller 16 is a conventional chiller and is used to assure that the liquids passing therethrough into bottle 20 have been suitably chilled. Chilling renders the resultant beverage immediately potable and also reduces the tendency for the carbonated water 42 to effervesce. Chiller 16 also provides a uniform temperature for the various liquids passing therethrough.

Purified water system 30 directs a purified water 32 into bottle 20 with the flow thereof being controlled by control console 12. Specifically, control console 12 will activate pump 34 and a valve 36 to introduce purified water 32 into bottle 20. Purified water 32 can be the sole liquid introduced into bottle 20 or it can be selectively mixed with the particular syrup for which it is programmed through control console 12. Further, purified water 32 can also be used as a diluent for a carbonated water 42 to produce a low carbonation beverage in bottle 20 where desired.

Carbonated water system 40 delivers carbonated water 42 which is prepared from purified water 32 that has been carbonated with carbon dioxide 22. Carbonated water 42 is pumped by a pump 44 into bottle 20 as regulated by a valve 46. Carbonated water 42 is suitably prechilled by chiller 16 as necessary for it to retain the desired degree of carbonation.

Syrup 52 for the practice of this invention is delivered by syrup system 50 which obtains syrup 52 from a plurality of bulk syrup containers 53*a*–53*c*. Syrup 52 is delivered by a pump 54 into bottle 20 as regulated by a valve 56. Bulk syrup containers 53*a*–53*c* are conventional bulk syrup containers which are generally configured with a collapsible plastic bag housed within a cardboard box. The plastic bag includes a fill neck 55*a*–55*c* having an inlet and an outlet to accommodate syrup containers 53*a*–53*c* being coupled in series to syrup system 50. This feature assures that a nearly continuous supply of syrup is readily available for delivery to bottle 20. Since syrup 52 is contained within a plastic bag (not shown) each successive plastic bag will collapse sequentially from syrup container 53*a* to syrup container 53*c* as syrup 52 is withdrawn therefrom. As illustrated herein, only three syrup containers, bulk syrup containers 53*a*–53*c*, are shown herein although it is to be understood that additional or fewer syrup containers can be coupled to syrup system 50. A valve 56 on fill neck 55*c* closes the inlet to bulk syrup container 53*c* but would otherwise be the connecting point for the next, succeeding syrup container (not shown). Although not shown in FIG. 1 it is to be understood that a plurality of syrup systems such as the syrup systems controlled by valves 56*a*–56*f* (FIG. 2) are included within the configuration of liquid proportioning apparatus 10 to thereby provide the customer with any suitable number of flavored syrups from which to choose.

Figure 2:
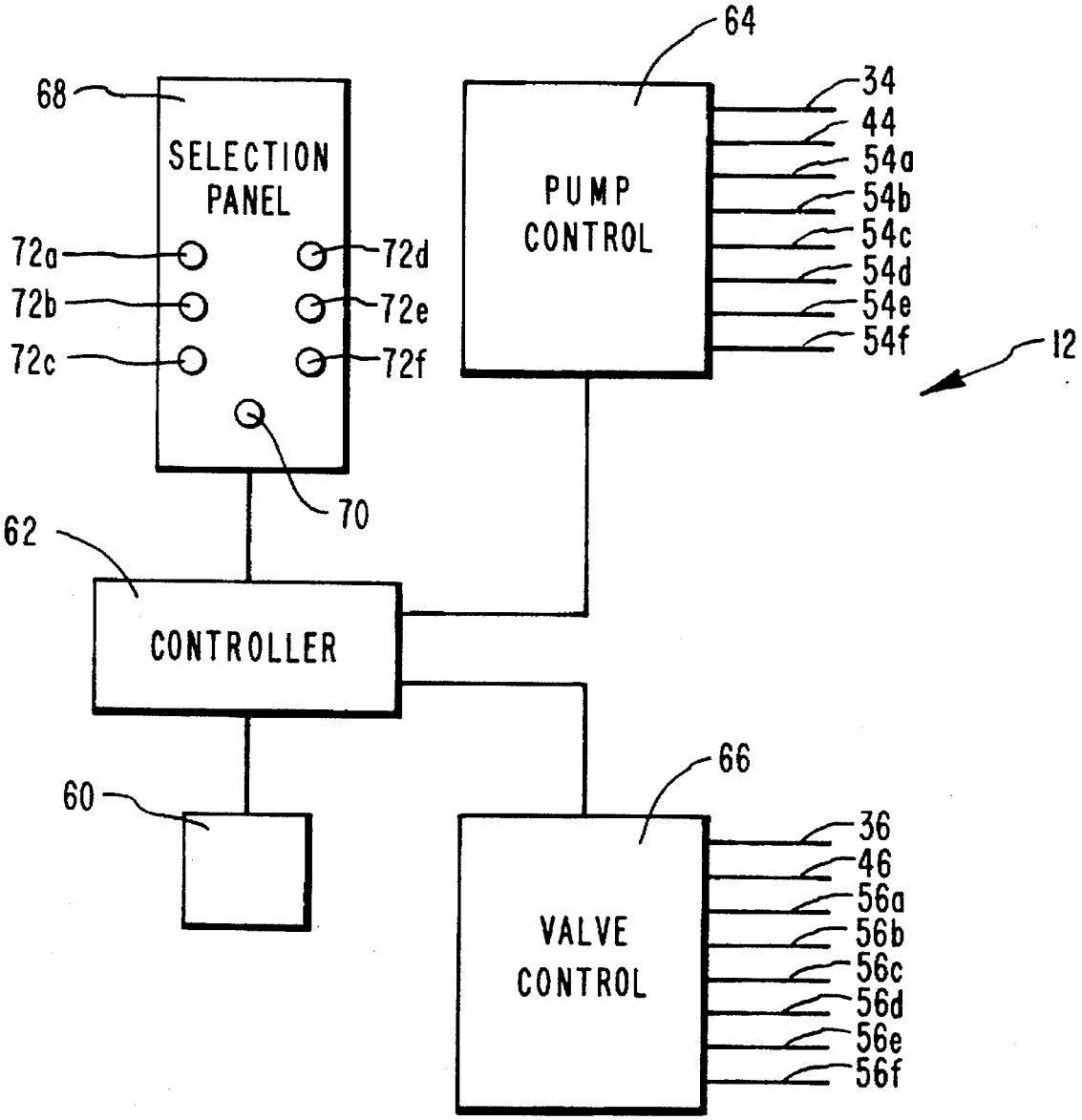
FIG. 2 is a schematic of the control system for controlling the flow of liquid in the liquid handling system of FIG. 1.

Referring now also to FIG. 2, control console 12 is shown in greater detail and includes a controller 62, a pump control 64, a valve control 66, and a selection panel 68. At this point it should be noted that all of the elements of control console 12 are effectively contained in a single housing but are shown separately herein to more readily describe these components. Pressure sensor 60 is also shown coupled to controller 62 since pressure sensor 60 plays a vital role in establishing the correct proportion of syrup 52 to carbonated water 42 and/or purified water 32. Controller 62 is selectively programmable to adapt liquid proportioning apparatus to any preselected ratio between syrup 52 and carbonated water 42, purified water 32, or a low carbonation provided by selectively proportioning purified water 32 with carbonated water 42.

Controller 62 selectively regulates pump control 64 which provides the control mechanism for each of pump 34, pump 44, and pumps 54*a*–54*f* as represented by the respectively labelled electrical leads extending from pump control 64. This configuration allows pump control 64, as regulated by controller 62 to selectively operate each of the designated pumps in order to pump the selected liquid at the preselected time. Controller 62 also selectively regulates valve control 66 which individually operates each of the valves controlled thereby, valve 36, valve 46, and valves 56*a*–56*f*, as represented by the respectively labelled electrical leads extending from valve control 66.

Controller 62 receives beverage selection input from selection panel 68 which includes thereon beverage selection switches as represented by purified water switch 70 and flavor switches 72*a*–72*f*. Clearly, of course, no switch is provided for carbonated water 42 since carbonated water 42 alone is generally considered to be nonpotable. The customer (not shown) approaches selection panel 68 and selects any one of the designated switches, purified water switch 70 or flavor switches 72*a*–72*f*. For example, if purified water switch 70 is activated controller 62 sends the appropriate signal to pump control 64 to activate purified water pump 34 and to valve control 66 to regulate valve 36. With bottle 20 properly engaged to fill head 14 purified water 32 is introduced into bottle 20.

Selection of flavor switches 72*a*–72*f* activates the novel liquid proportioning apparatus and method of this invention to achieve the desired ratio of syrup to water, carbonated water, or water/carbonated water. For example, juices such as apple, and the like, are generally not carbonated so that if syrup switch 72*a* were the designated switch for an apple-flavored beverage then activation of syrup switch 72*a* would cause apple syrup to be dispensed into bottle 20 as syrup 52 until the increased pressure sensed by pressure sensor 60 indicates that sufficient apple syrup has been dispensed into bottle 20. Pump control 64 then stops pump 54*a* and valve control 66 closes syrup valve 56*a*. Pump control 64 then activates pump 34 and opens valve 36 to fill the remainder of bottle 20 with purified water 32. Vent valve 21 is also opened to allow residual gas 23 in bottle 20 to escape through outlet line 18 as exhaust gas 24. When bottle 20 is filled controller 62 activates pump control 64 to stop pump 34 and valve control 66 to close valve 36.

Selection of a flavor switch for a high carbonation beverage flavor such as a cola, root beer, or lemon/lime will cause bottle 20 to be filled with the appropriate ratio of syrup 52 to carbonated water 42. Controller 62 receives the signal from flavor switch 72*b* which is the flavor for, say, a cola and in turn regulates pump control 64 which activates pump 54*b* to pump syrup 52, in this instance a cola flavor, through syrup line 50 to valve 56 where valve control 66 opens valve 56 to introduce syrup 52 into bottle 20. After pressure sensor 60 senses the predetermined rise in the internal pressure of residual gas 23 syrup valve 56 is closed and syrup pump 54 is stopped. The filling sequence for carbonated water 42 is commenced by opening vent valve 21 slightly to allow exhaust gas 24 to escape while maintaining a preselected back pressure on residual gas 23 with pump 44 being activated and valve 46 opened to fill the remainder of bottle 20 with carbonated water 42. When bottle 20 has been suitably filled valve 46 is closed and pump 44 stopped to discontinue the delivery of carbonated water 42 to bottle 20.

Selection of a beverage flavor for a beverage requiring a reduced degree of carbonation requires not only the correct proportion of the syrup for the flavor but also the correct proportion of purified water 32 to carbonated water 42. For example, if one were to select as a flavor the syrup 52 for, say, orange-pineapple, as a fruit-flavored ado and this particular flavor were represented by flavor switch 72*c* controller 62 is preprogrammed to produce a beverage of orange-pineapple having a reduced carbonation. This is accomplished by pump control 64 activating pump 54 to cause orange-pineapple syrup 52 to be directed into bottle 20. Upon the correct quantity of syrup 52 being received in bottle 20 as determined by pressure sensor 60 as set forth hereinbefore, pump 54 is stopped and valve 56 is closed. Purified water 32 is then introduced into bottle 20 until pressure sensor 60 detects the preselected increase in pressure of residual gas 23 to a third pressure setting at which time valve 36 is closed and pump 34 stopped to discontinue the delivery of purified water 32 into bottle 20. In effect, the delivery of purified water 32 into bottle 20 has been essentially identical to the delivery of syrup 52 with the only difference being the different pressure settings imposed on residual gas 23. In both of these cases, vent valve 21 remains closed in order to maintain the integrity of the pressure increases imposed on residual gas 23 by the introduction of, first, syrup 52, and second, purified water 32. The balance of the capacity of bottle 20 is then filled with carbonated water 42 as described hereinbefore to thereby produce the low carbonation beverage selected upon activation of flavor switch 72*c*.

The Method

The novel method of this invention is made possible by the use of pressure sensor 60 which accurately senses the increase in pressure inside bottle 20 as syrup 52 is introduced therein. Initially bottle 20 is sealingly engaged to fill head 14 at seal 15 and gas 22 is introduced into bottle 20 as gas 23 through inlet gas line 26 as controlled by inlet valve 27 until the pressure on gas 23 inside bottle 20 reaches the first pressure setting. Upon reaching this first pressure setting the flow of gas 22 is stopped by inlet valve 27 while valve 56 is opened and pump 54 started to direct syrup 52 into bottle 20. The introduction of syrup 52 into bottle 20 compresses gas 23. Pressure sensor 60 detects this increase in pressure; and upon reaching the second preselected pressure setting, pressure sensor 60 causes valve 56 to be closed and pump 54 to be stopped. The ratio between the second pressure setting and the first pressure setting is an accurate determination of the correct quantity of syrup 52 in bottle 20 in order to achieve the desired proportion of syrup 52 in the selected beverage.

Importantly, the ratio of syrup 52 to the capacity of bottle 20, as reflected by the ratio of the second pressure setting to the first pressure setting, is constant regardless of the capacity of bottle 20. This feature can be easily demonstrated mathematically by the mathematical formula for the relationship between pressure and volume known as Boyle Law which states that at constant temperature the volume of a gas varies inversely as the pressure and can be written as follows:

$$PV=nRT$$

where P is pressure, V is volume, T is temperature and the symbols n and R represent constants for the particular gas involved.

Another formula for representing this law at constant temperature is as follows:

$$P_1V_1=P_2V_2 \text{ or } V_1/V_2=P_2/P_1$$

This shows that there is a very straight forward relationship between the volume of syrup 52 introduced into bottle 20 and the pressure change in bottle 20 caused by the introduction of syrup 52.

Advantageously, at the relatively modest pressures involved in the practice of my novel invention the relationship between pressure and volume is for all practical purposes a near linear relationship. This means that when starting from a known pressure on gas 23 as determined by the first pressure setting by pressure sensor 60 the increase in pressure on gas 23 as syrup 52 enters bottle 20 will be a direct correlation between the quantity of syrup 52 and the remaining capacity of bottle 20. Upon reaching the preselected second pressure setting on pressure sensor 60 bottle 20 now has the precise quantity of syrup 52 to produce the correct proportion of syrup 52 in the resultant beverage in bottle 20.

In the event it is desirable to produce a beverage having a low carbonation content one simply follows the foregoing steps while introducing purified water 32 into bottle 20 prior to the introduction of carbonated water 42. Specifically, valve 36 is opened and pump 34 is activated to inject purified water 32 into bottle 20 until a preselected third pressure setting is reached at which time valve 36 is closed and pump 34 stopped. This third pressure setting sensed by pressure sensor 60 is representative of the proportion of purified water 32 to the total capacity of bottle 20, or more accurately, the residual head space of gas 23 in bottle 20 above the level of syrup 52 and purified water 32 as shown.

Carbonated water 42 is introduced last into bottle 20. This is accomplished by opening vent valve 21 to allow gas 23 to escape as exhaust gas 24 under a controlled leak configuration by vent valve 21 so as to retain a residual back pressure on gas 23. Valve 46 is simultaneously opened and pump 44 activated to pump carbonated water 42 into bottle 20. When the upper level of liquid in bottle 20 reaches the bottom of fill head 14 it interferes with the escape of gas 23 causing a sharp pressure surge in pressure sensor 60. This sharp pressure surge is sensed by pressure sensor 60 causing it to send a shut off signal through controller 62 to valve control 66 to close valve 46 and to pump control 54 to stop pump 44.

A beverage having only carbonated water 42 added to syrup 52 is obtained by simply eliminating the introduction of purified water 32 into bottle 20 while following all of the other steps necessary to fill bottle 20 with the beverage of choice. In particular, upon attachment of bottle 20 to fill head 14 and activation of the appropriate syrup switch **72*a*–72*f* vent valve 21 is closed and gas 22 is introduced into bottle 20 through inlet valve 27 until the first pressure setting is attained. This first pressure setting provides a base line from which all changes in pressure are detected by pressure sensor 60 to thereby compensate for differences in the ambient atmospheric pressure due different altitudes or changing weather, etc. Upon reaching this base line or first pressure setting inlet valve 27 is closed and syrup 52 is introduced into bottle by the appropriate operation of pump 54 and valve 56. The entry of syrup 52 into bottle 20 displaces and thus compresses gas 23 until pressure sensor 60 senses the second pressure setting at which time pump 54 is stopped and valve 56 is closed to stop the flow of syrup 52. Since the proportional relationship between the first and second pressure settings is effectively linear at the relatively low pressures involved herein, the correct quantity of syrup 52 is introduced into bottle 20 each time regardless of the capacity of bottle 20. This means that a half liter bottle 20 will have the same ratio of syrup 52 to carbonated water 42 as will a two or three liter bottle 20**.

The balance of the capacity of bottle 20 is then filled with carbonated water 42 by opening vent valve 21 to allow gas 23 to escape as exhaust gas 24 while maintaining a limited back pressure on gas 23. Valve 46 is opened and pump 44 is operated to direct carbonated water 42 into bottle 20. As the level of liquid in bottle 20 reaches the bottom of fill head 14 to where it interferes with the escape of exhaust gas 24 it causes a sharp pressure spike which is detected by pressure sensor 60 to shut off pump 44 and close valve 46. Bottle 20 is now filled with a beverage having a high carbonation and is ready to be removed from fill head 14 and capped. Clearly of course, some mixing of syrup 52 with carbonated water 42 is necessary since syrup 52 is contained in the bottom of bottle 20. This is done by gently inverting capped bottle 20 several times to cause syrup 52 to become intimately dispersed throughout the beverage in bottle 20.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A liquid proportioning apparatus comprising:

a fill head;

a container sealingly attached to said fill head;

a pressure sensor in fluid communication with the interior of said container;

pressurization means for pressurizing said container with a gas to a first pressure setting on said pressure sensor;

injection means for introducing a first liquid into said container, said first liquid compressing said gas in said container to a second pressure setting as sensed by said pressure sensor;

pressure release means for releasing said pressure in said container; and fill means for filling said container with a second liquid.

2. The liquid proportioning apparatus defined in claim 1 wherein said apparatus includes fill means for injecting a third liquid into said container to raise said pressure in said container to a third pressure prior to releasing said pressure with said pressure release means.

3. The liquid proportioning apparatus defined in claim 1 wherein said pressurization means comprises a carbon dioxide gas for pressurizing said container.

4. The liquid proportioning apparatus defined in claim 1 wherein said second liquid comprises carbonated water and said pressure release means comprises a restriction means for holding a back pressure on said container to reduce effervescence of said carbonated water.

5. The liquid proportioning apparatus defined in claim 1 wherein said fill means includes a pressure change sensor means for sensing a pressure spike to stop said fill means.

6. An apparatus for producing a beverage from accurate proportions of a flavored syrup and a water comprising;

a fill head;

a bottle suitable for receiving said beverage;

seal means for releasably sealing said bottle to said fill head;

a pressure sensor for sensing pressure in said bottle;

gas means for pressurizing said bottle to a first pressure setting;

syrup means for introducing said flavored syrup into said bottle, said flavored syrup compressing said gas from said first pressure setting to a second pressure setting;

vent means for venting said gas from said bottle; and fill means for filling said bottle with said water.

7. The apparatus defined in claim 6 wherein said water comprises a water selected from the group consisting of water and carbonated water.

8. The apparatus defined in claim 6 wherein said apparatus includes a liquid means for introducing a liquid into said bottle after said syrup said liquid compressing said gas to a third pressure setting.

9. A method for proportioning at least two liquids in a container comprising the steps of:

pressurizing said container with a gas to a first pressure setting;

increasing the pressure in said container from said first pressure setting to a second pressure setting by introducing a first liquid into said container;

said first liquid compressing said gas to said second pressure setting;

venting said gas from said container; and filling said container with a second liquid.

10. The method defined in claim 9 wherein said increasing step is followed by a second increasing step by compressing said gas to a third pressure setting by introducing said second liquid into said container prior to said venting step and following said venting step by introducing a third liquid into said container.

11. The method defined in claim 10 wherein said venting step comprises creating a back pressure on said gas by restricting said gas during said venting step, said back pressure reducing effervescence of carbonated water when said carbonated water is said second liquid and said third liquid.

12. The method defined in claim 9 wherein said pressurizing step comprises selecting carbon dioxide as said gas.

13. The method defined in claim 9 wherein said increasing step includes producing a beverage in said container by selecting a flavored syrup as said first liquid.

14. The method defined in claim 13 wherein said selecting step includes providing a plurality of bulk containers of said syrup and interconnecting said bulk containers in fluid communication in series thereby providing an extended supply of said syrup.

15. The method defined in claim 9 wherein said filling step includes creating a pressure spike during said venting step by interrupting said venting step upon filing said container with said second liquid and sensing said pressure spike thereby terminating said filling step.

* * * * *